US012158271B2

(12) United States Patent
Engelhardt

(10) Patent No.: US 12,158,271 B2
(45) Date of Patent: Dec. 3, 2024

(54) PREMIXER INJECTOR IN GAS TURBINE ENGINE

(71) Applicant: SIEMENS ENERGY GLOBAL GMBH & CO. KG, Munich (DE)

(72) Inventor: Matthew Engelhardt, Vancouver (CA)

( * ) Notice: Subject to any disclaimer, the term of this patent is extended or adjusted under 35 U.S.C. 154(b) by 0 days.

(21) Appl. No.: 18/275,081

(22) PCT Filed: Feb. 23, 2021

(86) PCT No.: PCT/US2021/019146
§ 371 (c)(1),
(2) Date: Jul. 31, 2023

(87) PCT Pub. No.: WO2022/182324
PCT Pub. Date: Sep. 1, 2022

(65) Prior Publication Data

US 2024/0085024 A1 Mar. 14, 2024

(51) Int. Cl.
*F23R 3/28* (2006.01)
*F23R 3/36* (2006.01)

(52) U.S. Cl.
CPC ..... *F23R 3/286* (2013.01); *F23R 3/36* (2013.01)

(58) Field of Classification Search
CPC .. F23R 3/286; F23R 3/283; F23R 3/36; F23D 17/002; F23D 11/40
See application file for complete search history.

(56) References Cited

U.S. PATENT DOCUMENTS 5,850,732 A * 12/1998 Willis ..... F23R 3/42 60/804
6,176,087 B1 * 1/2001 Snyder ..... F23R 3/12 60/737
8,205,452 B2 * 6/2012 Boardman ..... F23R 3/283 60/737
8,418,469 B2 * 4/2013 Myers ..... F23R 3/14 60/737
8,464,537 B2 * 6/2013 Khan ..... F23R 3/286 60/737
8,607,569 B2 * 12/2013 Helmick ..... F23R 3/286 60/737
8,683,804 B2 * 4/2014 Boardman ..... F23R 3/286 60/737

(Continued)

FOREIGN PATENT DOCUMENTS

EP 2735797 A1 * 5/2014 ..... F23R 3/12
WO 9322601 A1 11/1993

OTHER PUBLICATIONS

PCT International Search Report and Written Opinion of the International Searching Authority mailed Nov. 16, 2021 corresponding to PCT Application No. PCT/US2021/019146 filed Feb. 23, 2021.

*Primary Examiner* — Alain Chau

(57) ABSTRACT

A premixer injector in a gas turbine engine includes an inlet end, an outlet end, a first wall and a second wall between the inlet end and the outlet end. The first wall has a plurality of apertures circumferentially separated around the first wall and axially separated along the first wall. Each aperture passes through the first wall. A premixer duct is defined by an interior of the first wall. The second wall at least partially surrounds the first wall. A secondary duct is defined between the first wall and the second wall.

19 Claims, 5 Drawing Sheets

(56) References Cited

U.S. PATENT DOCUMENTS

| | | | | |
|---|---|---|---|---|
| 9,366,432 | B2 * | 6/2016 | Mitchell | F23R 3/32 |
| 9,476,592 | B2 * | 10/2016 | Berry | F23R 3/10 |
| 9,599,343 | B2 * | 3/2017 | Abd El-Nabi | F23D 11/402 |
| 10,184,664 | B2 * | 1/2019 | Chen | F23R 3/286 |
| 10,197,282 | B2 * | 2/2019 | Mitchell | F23L 15/04 |
| 2010/0192579 | A1 * | 8/2010 | Boardman | F23R 3/34 60/737 |
| 2011/0000214 | A1 | 1/2011 | Helmick et al. | |
| 2011/0107764 | A1 * | 5/2011 | Bailey | F01D 25/28 60/737 |
| 2011/0113783 | A1 * | 5/2011 | Boardman | F23R 3/286 60/737 |
| 2011/0314827 | A1 | 12/2011 | Khosla et al. | |
| 2012/0011854 | A1 * | 1/2012 | Khan | F23R 3/283 60/754 |
| 2012/0174590 | A1 * | 7/2012 | Krull | F23R 3/286 73/112.01 |
| 2013/0306181 | A1 * | 11/2013 | Mitchell | F23L 15/04 137/888 |
| 2014/0144142 | A1 | 5/2014 | Abd El-Nabi et al. | |
| 2014/0238025 | A1 * | 8/2014 | Uhm | F23R 3/286 60/737 |
| 2015/0000286 | A1 * | 1/2015 | LeBegue | F23R 3/286 60/742 |
| 2016/0033135 | A1 * | 2/2016 | Chen | F23R 3/32 60/737 |
| 2016/0258630 | A1 * | 9/2016 | Mitchell | F02C 3/22 |
| 2017/0254540 | A1 * | 9/2017 | DiCintio | F02C 7/228 |
| 2018/0363906 | A1 | 12/2018 | Bailey et al. | |

* cited by examiner

PREMIXER INJECTOR IN GAS TURBINE ENGINE

BACKGROUND

An industrial gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes.

The gas turbine engine may include premixer injectors for providing a mixture of air and fuel for the combustors. The premixer injectors effectively mix the air and fuel. The premixer injectors may also damp out thermo-acoustic instability.

BRIEF SUMMARY

In one aspect, a premixer injector in a gas turbine engine includes an inlet end; an outlet end; a first wall between the inlet end and the outlet end, the first wall comprising a plurality of apertures circumferentially separated around the first wall and axially separated along the first wall, each aperture passing through the first wall; a premixer duct defined by an interior of the first wall; a second wall between the inlet end and the outlet end, the second wall at least partially surrounding the first wall; and a secondary duct defined between the first wall and the second wall.

In another aspect, a premixer injector operable to mix a fuel and an air includes a first wall enclosing a premixer duct having an inlet end for an admission of a primary air flow into the premixer duct and an outlet end for a discharge of a mixture of fuel and air, the first wall including a plurality of apertures circumferentially separated around the first wall and axially separated along the first wall, each aperture passing through the first wall; a fuel lance disposed in the premixer duct at the inlet end, the fuel lance operable to inject the fuel into the premixer duct; and a second wall positioned to at least partially surround the first wall defining a secondary duct therebetween, the second wall having an inlet end for an admission of a secondary air flow into the secondary duct, wherein the secondary air flow enters the premixer duct via the plurality of apertures and is added to the mixture of fuel and air.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
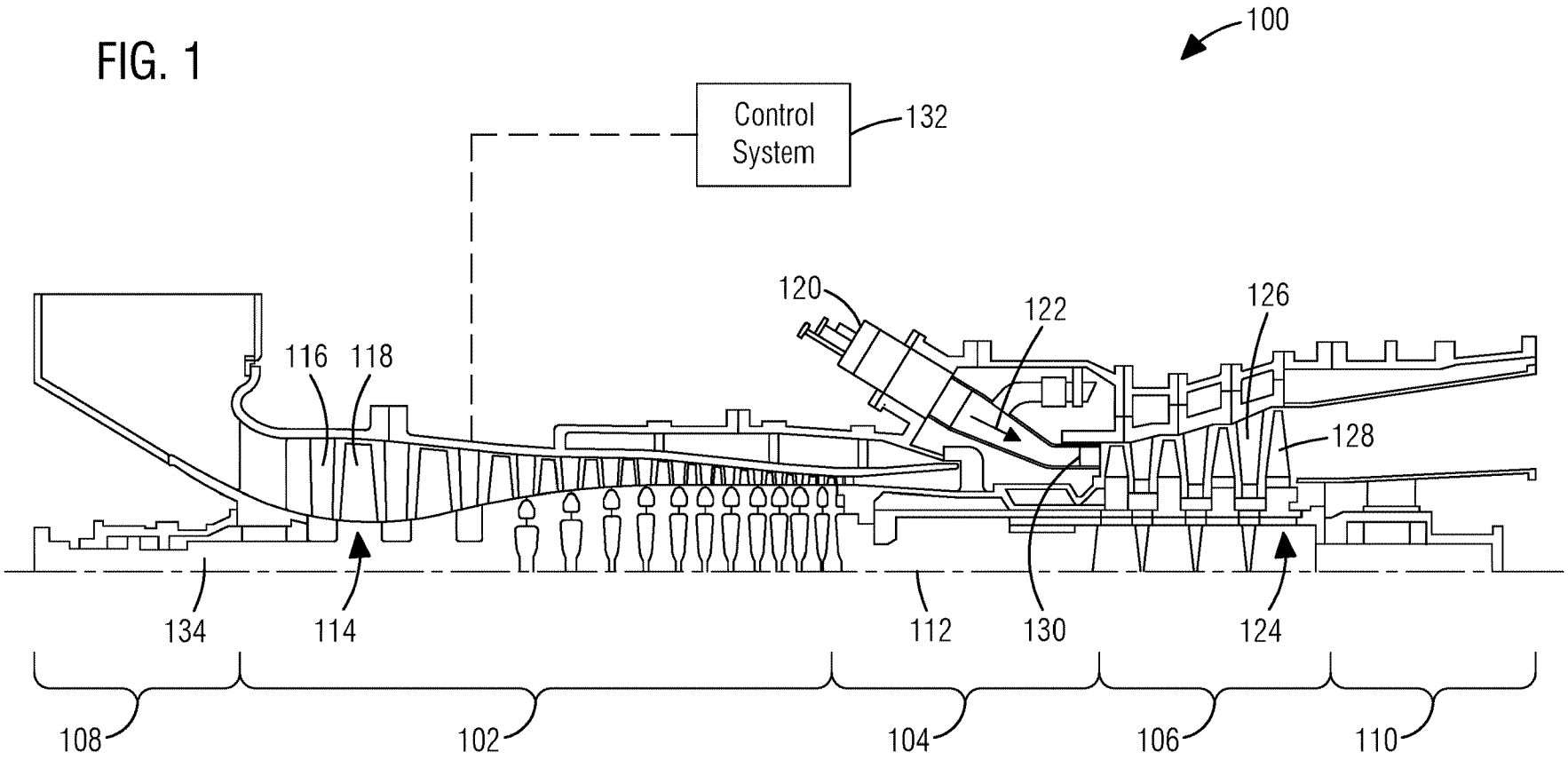
FIG. 1 is a longitudinal cross-sectional view of a gas turbine engine 100 taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a central axis 112. The compressor section 102 includes a plurality of compressor stages 114 with each compressor stage 114 including a set of stationary vanes 116 or adjustable guide vanes and a set of rotating blades 118. A rotor 134 supports the rotating blades 118 for rotation about the central axis 112 during operation. In some constructions, a single one-piece rotor 134 extends the length of the gas turbine engine 100 and is supported for rotation by a bearing at either end. In other constructions, the rotor 134 is assembled from several separate spools that are attached to one another or may include multiple disk sections that are attached via a bolt or plurality of bolts.

The compressor section 102 is in fluid communication with an inlet section 108 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120 that each operate to mix a flow of fuel with the compressed air from the compressor section 102 and to combust that air-fuel mixture to produce a flow of high temperature, high pressure combustion gases or exhaust gas 122. Of course, many other arrangements of the combustion section 104 are possible.

The turbine section 106 includes a plurality of turbine stages 124 with each turbine stage 124 including a number of stationary turbine vanes 126 and a number of rotating turbine blades 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 110 is positioned downstream of the turbine section 106 and is arranged to receive the expanded flow of exhaust gas 122 from the final turbine stage 124 in the turbine section 106. The exhaust portion 110 is arranged to efficiently direct the exhaust gas 122 away from the turbine section 106 to assure efficient operation of the turbine section 106. Many variations and design differences are possible in the exhaust portion 110. As such, the illustrated exhaust portion 110 is but one example of those variations.

A control system 132 is coupled to the gas turbine engine 100 and operates to monitor various operating parameters and to control various operations of the gas turbine engine 100. In preferred constructions the control system 132 is typically micro-processor based and includes memory devices and data storage devices for collecting, analyzing, and storing data. In addition, the control system 132 provides output data to various devices including monitors, printers, indicators, and the like that allow users to interface with the control system 132 to provide inputs or adjustments. In the example of a power generation system, a user may input a power output set point and the control system 132 may adjust the various control inputs to achieve that power output in an efficient manner.

The control system 132 can control various operating parameters including, but not limited to variable inlet guide vane positions, fuel flow rates and pressures, engine speed, valve positions, generator load, and generator excitation. Of course, other applications may have fewer or more controllable devices. The control system 132 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
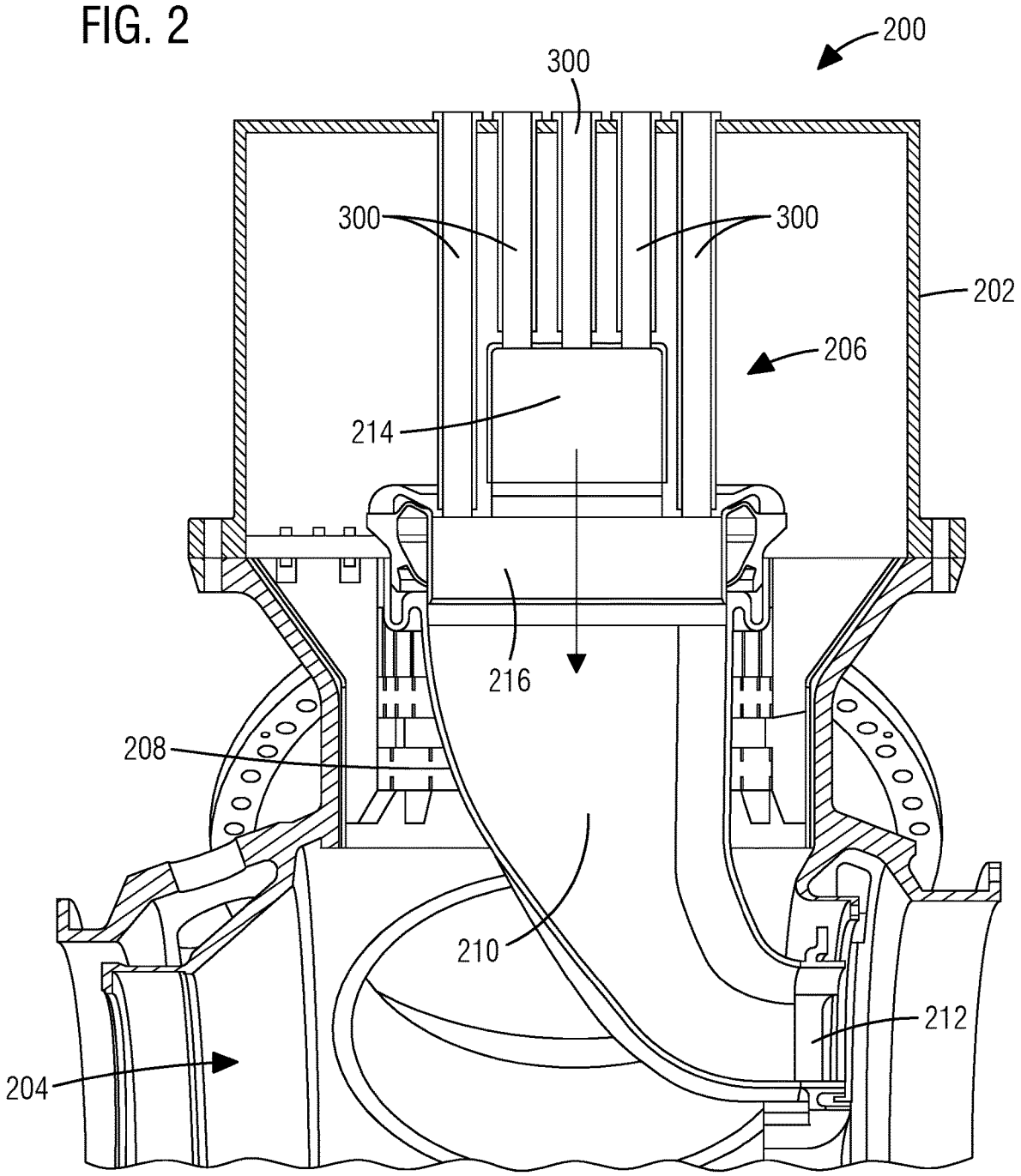
FIG. 2 is a section view of a combustor suitable for use in the combustion section of the gas turbine engine of FIG. 1.

FIG. 2 is a section view of a combustor 200 suitable for use in the combustion section 104 of the gas turbine engine 100 of FIG. 1. The combustor 200 includes a casing 202, an inlet 204, a premixer injector assembly 206, a combustor liner 208 defining a combustor chamber 210 and a chamber exit 212. The casing 202 encloses the premixer injector assembly 206 and the combustor liner 208. The premixer injector assembly 206 is disposed upstream of the combustor chamber 210.

The premixer injector assembly 206 includes a plurality of premixer injectors 300. The premixer injectors 300 are assembled in at least one block. As illustrated in FIG. 2, a number of the premixer injectors 300 are assembled in a primary block 214 and a remaining number of the premixer injectors 300 are assembled in a secondary block 216. The primary block 214 is disposed upstream of the secondary block 216. The premixer injectors 300 are parallel to each other. The premixer injectors 300 are orientated perpendicular to the top surface of the primary block 214 or perpendicular to the top surface of the secondary block 216. In other constructions, it is possible that the premixer injectors 300 may be assembled in the primary block 214 and secondary block 216 in other configurations, such as not parallel to each other, or not perpendicular to the top surface of the primary block 214 or not perpendicular to the top surface of the secondary block 216. It is also possible that all the premixer injectors 300 are assembled in single block.

Figure 3:
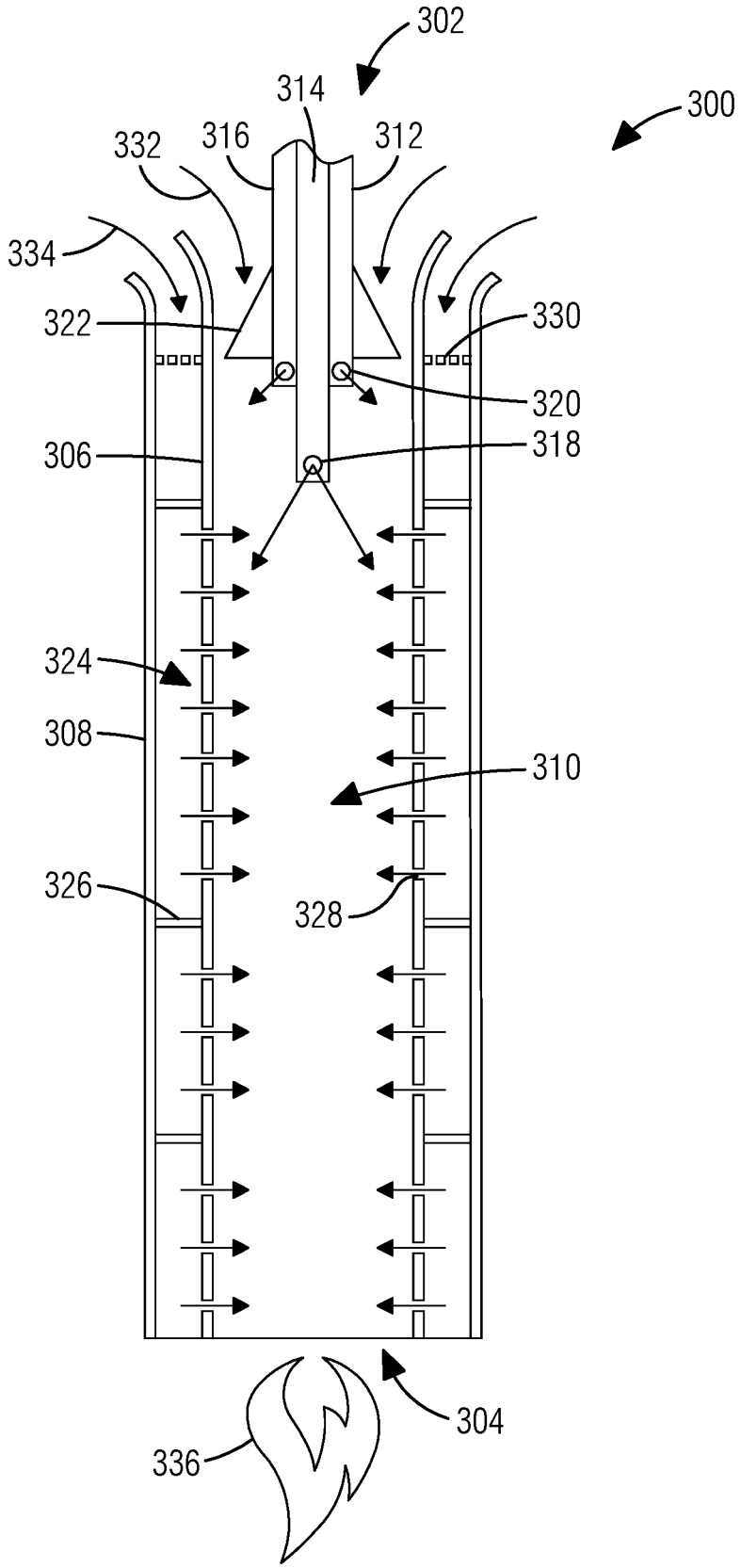
FIG. 3 is a section view of a premixer injector suitable for use in the combustor of FIG. 2.

FIG. 3 is a section view of one of the premixer injectors 300 suitable for use in the arrangement illustrated in FIG. 2. The premixer injector 300 has a general cylindrical shape having an inlet end 302 and an outlet end 304. The premixer injector 300 includes a first wall 306 and a second wall 308. The second wall 308 at least partially surrounds the first wall 306. The first wall 306 encloses a hollow interior defining a premixer duct 310. The first wall 306 has a circular cross section and extends in a general straight shape. The second wall 308 has a circular cross section and extends in a general straight shape. The first wall 306 and the second wall 308 cooperate to define an annular chamber therebetween. The annular chamber extends from the inlet end 302 to the outlet end 304 and defines a distance between the second wall 308 and the first wall 306. The distance is constant between the inlet end 302 and the outlet end 304 of the premixer injector 300. It is possible that the distance between the second wall 308 and the first wall 306 varies between the inlet end 302 and the outlet end 304 of the premixer injector 300.

The premixer injector 300 includes a fuel lance 312 disposed in the premixer duct 310 at the inlet end 302 for feeding fuel to the premixer duct 310. The fuel lance 312 includes a liquid fuel tube 314 and a gas fuel tube 316. The gas fuel tube 316 surrounds the liquid fuel tube 314. The liquid fuel tube 314 has a liquid fuel outlet 318 through which the liquid fuel flows into the premixer duct 310. The gas fuel tube 316 has a gas fuel outlet 320 through which the gas fuel flows into the premixer duct 310. The fuel lance 312 includes at least one vortex generator 322 attached to an outer wall of the fuel lance 312. Each vortex generator 322 has a generally triangular shape. It is possible that one or more of the vortex generators 322 may have any desired shapes, such as rectangular, circular, arch, etc. In the illustrated construction, the fuel lance 312 has a plurality of vortex generators 322. The vortex generators 322 are attached around an outer perimeter of an outer wall of the gas fuel tube 316. It is possible that the liquid fuel tube 314 may surround the gas fuel tube 316 and the vortex generators 322 are attached around an outer perimeter of an outer wall of the liquid fuel tube 314. It is also possible that the fuel lance 312 may have only the liquid fuel tube 314 or only the gas fuel tube 316.

The premixer injector 300 includes a secondary duct 324 defined by the annual chamber between the first wall 306 and the second wall 308. The premixer injector 300 includes a plurality of struts 326 disposed in the secondary duct 324, The struts 326 are disposed between the first wall 306 and the second wall 308 for supporting the first wall 306. The plurality of struts 326 are disposed circumferentially around the secondary duct 324 at the same axial location. The struts 326 are axially separated from each other along the secondary duct 324 between the inlet end 302 and the outlet end 304.

The first wall 306 is a porous wall having a plurality of apertures 328. The apertures 328 are arranged in the first wall 306 between the inlet end 302 and the outlet end 304 of the premixer injector 300. Each apertures 328 passes through the first wall 306. The first aperture 328 is placed downstream of the outlet of the longer fuel tube. In the embodiment as illustrated in FIG. 3, the first aperture 328 is placed downstream of the liquid fuel outlet 318. The apertures 328 are circumferentially separated around the first wall 306. A row of apertures 328 is formed by the apertures 328 at the same axial location and different circumferential locations. The apertures 328 are axially separated along the first wall 306. A column of the apertures 328 is formed by the apertures 328 at the same circumferential location and different axially locations. The apertures 328 may be evenly distributed in the first wall 306 in one of the axial and circumferential directions, or both of the axial and circumferential directions. The apertures 328 may be unevenly distributed in the first wall 306 in one of the axial and circumferential directions, or both of the axial and circumferential directions. The number of apertures 328 and the distribution of apertures 328 in the first wall 306 are selected based on design requirement, such as the desired flow and acoustic behavior of the premixer injector 300.

The premixer injector 300 includes a perforated plate 330 disposed between the first wall 306 and the second wall 308 at the inlet end 302 of the premixer injector 300. The perforated plate 330 has a plurality of holes. The perforated plate 330 is placed continuously and circumferentially around the secondary duct 324. It is possible that the premixer injector 300 includes a plurality of perforated plates 330 placed circumferentially around the secondary duct 324 and spaced apart from each other.

Figure 4:
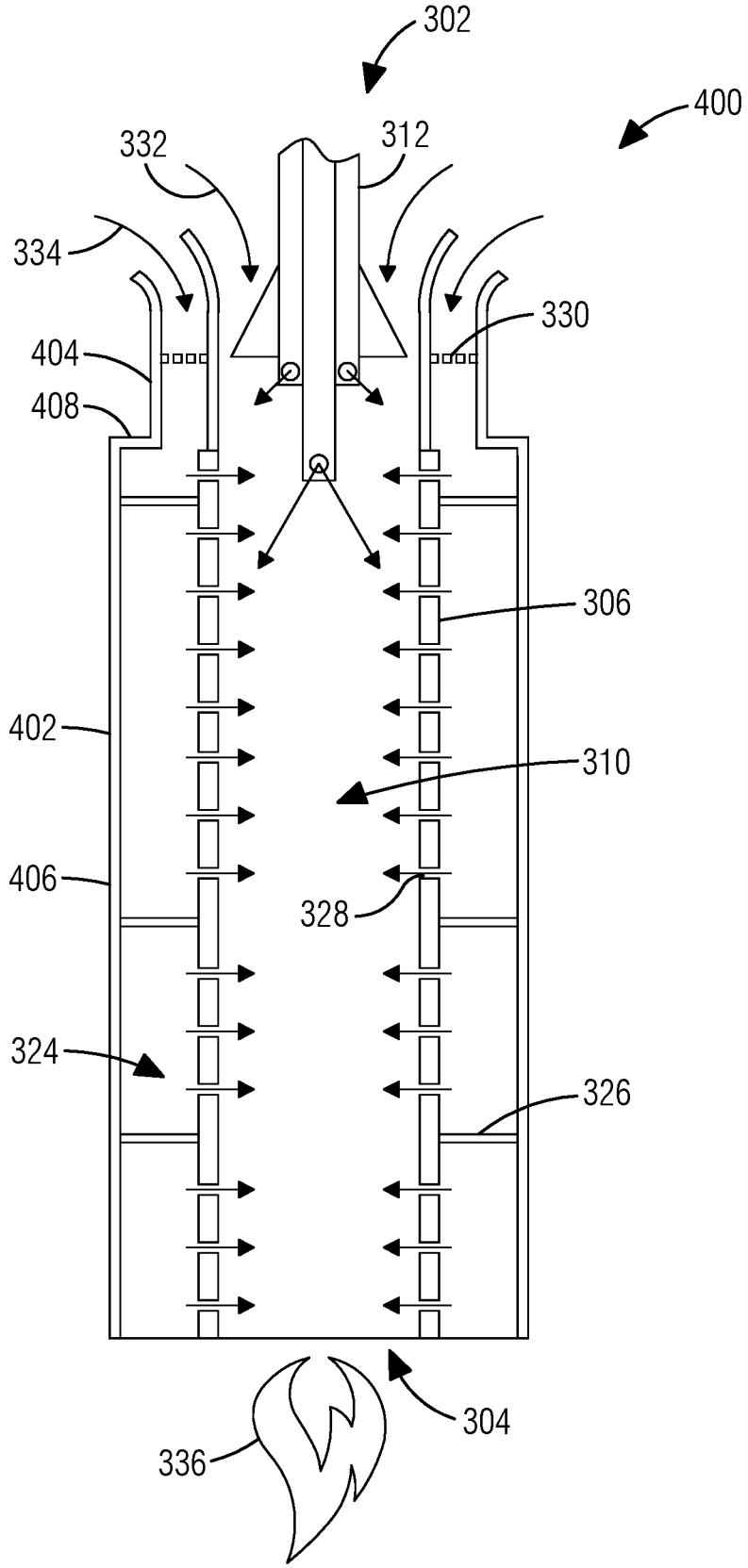
FIG. 4 is a section view of another premixer injector suitable for use in the combustor of FIG. 2.

FIG. 4 is a section view of another premixer injector 400 suitable for use in the arrangement illustrated in FIG. 2. The premixer injector 400 can be used in place of the premixer injector 300 or can be used in conjunction with the premixer injector 300.

An outer wall 402 of the premixer injector 400 has a first section 404 and a second section 406 connected to each other. A diameter of the first section 404 is different from a diameter of the second section 406. In the illustrated embodiment as shown in FIG. 4, the diameter of the first section 404 is less than the diameter of the second section 406. It is possible that the diameter of the first section 404 is larger than the diameter of the second section 406.

The first section 404 starts from the inlet end 302 and ends upstream of the outlet of the longer fuel tube. In the embodiments as illustrated in FIG. 4, the first section 404 ends upstream of the liquid fuel outlet 318. The second section 406 starts from the end of the first section 404 and connects the end of the first section 404 via a planar panel 408 forming a step-like shaped outer wall 402. The second section 406 extends to the outlet end 304.

Thickness of the first wall 306 is tuned based on design requirements. For example, a thickness of the first wall 306 in FIG. 4 is thicker than a thickness of the first wall 306 in FIG. 3. Volume of the secondary duct 324 is tuned based on design requirements. For example, the volume of the secondary duct 324 is tuned such that the secondary duct 324 is used as an acoustic resonator. A resonant frequency of the secondary duct 324 may be altered by modifying the thickness of the first wall 306.

Figure 5:
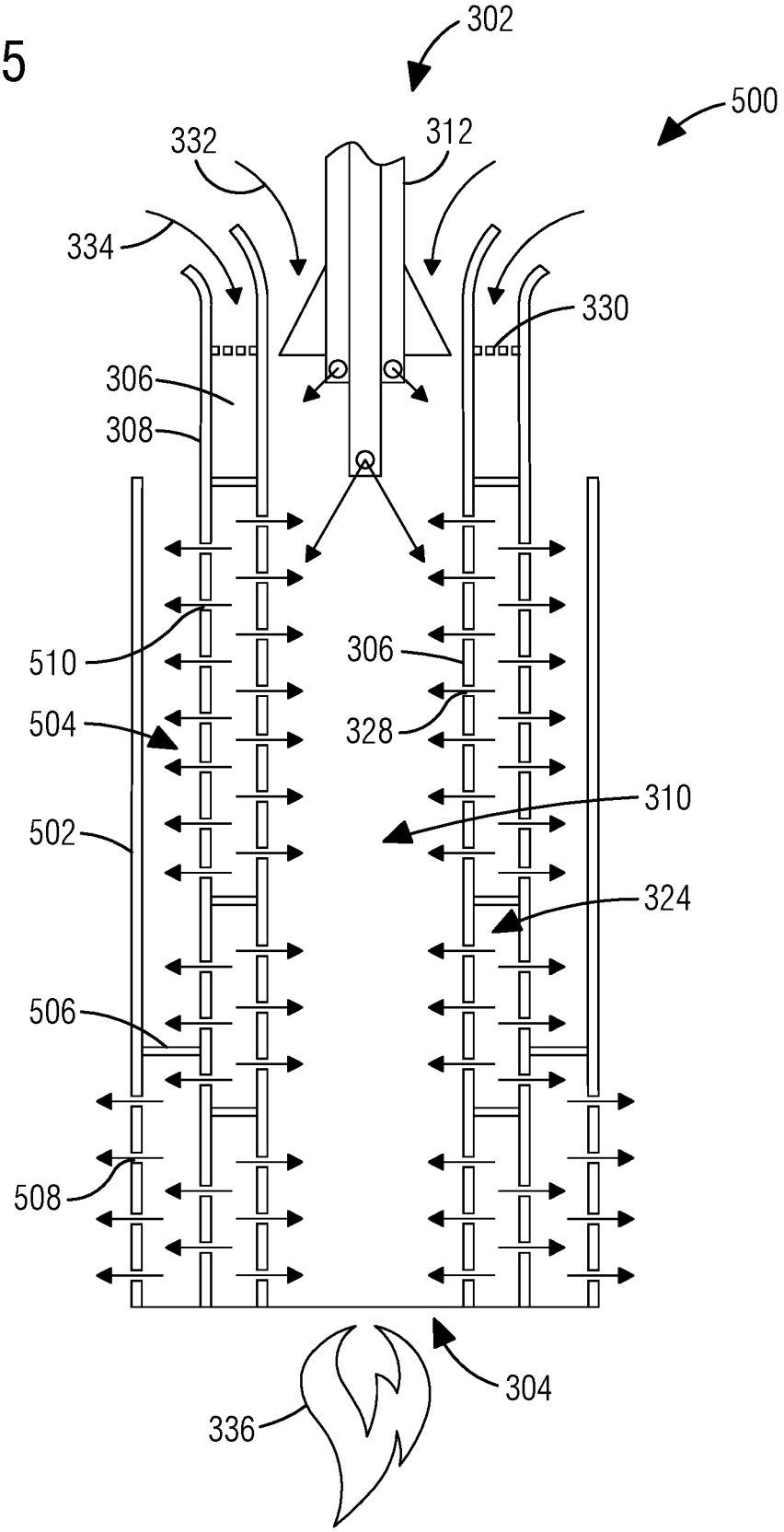
FIG. 5 is a section view of another premixer injector suitable for use in the combustor of FIG. 2.

FIG. 5 is a section view of another premixer injector 500 suitable for use in the arrangement illustrated in FIG. 2. The premixer injector 500 can be used in place of the premixer injector 300 or the premixer injector 400, or can be used in conjunction with the premixer injector 300 or the premixer injector 400

The premixer injector 500 includes a third wall 502. The third wall 502 at least partially surrounds the second wall 308. A third duct 504 is defined between the second wall 308 and the third wall 502. At least one bar 506 is disposed between the third wall 502 and the second wall 308. The bar 506 is circumferentially separated around the third duct 504. The bar 506 may be evenly or unevenly distributed around the third duct 504 in the circumferential direction. The bar 506 is an acoustically stiff boundary. The bar 506 is placed closer to the outlet end 304 than to the inlet end 302. It is possible that the bar 506 may be placed at any desired location between the inlet end 302 and the outlet end 304. The third wall 502 has a plurality of openings 508. The openings 508 are disposed downstream of the bar 506. The openings 508 are circumferentially separated around the third wall 502, evenly or unevenly. The openings 508 are axially separated along the opening 508, evenly or unevenly. A row of the openings 508 is formed by the openings 508 at the same axial location and different circumferential locations. A column pf the openings 508 is formed by the openings 508 at the same circumferential location and the different axial locations.

The second wall 308 is a porous wall including a plurality of orifices 510. The orifices 510 are distributed along the second wall 308 between the inlet end 302 and the outlet end 304 and spaced apart from each other. The orifices 510 are circumferentially separated around the second wall 308. The orifices 510 are axially separated along the second wall 308. The orifices 510 are axially unevenly distributed along the second wall 308. It is possible that the orifices 510 are axially evenly distributed along the first second wall 308. The orifices 510 may be circumferentially evenly around the second wall 308. It is also possible that the orifices 510 may be circumferentially unevenly around the second wall 308. A row of the orifices 510 is formed by the orifices 510 at the same axial location and different circumferential locations. A column of the orifices 510 is formed by the orifices 510 at the same circumferential location and the different axial locations. The orifices 510 are axially staggered with the apertures 328 in the first wall 306 along the secondary duct 324. It is possible that the orifices 510 may be distributed at the same axial location as the apertures 328 in the first wall 306 along the secondary duct 324. The orifices 510 may be circumferentially staggered with the apertures 328 in the first wall 306 around the secondary duct 324. It is possible that the orifices 510 may be distributed at the same circumferential location as the apertures 328 in the first wall 306 around the secondary duct 324.

In operation of the gas turbine engine 100 of FIG. 1, with reference to FIG. 2, air from the compressor section 102 flows into the combustor 200 through the inlet 204 and is injected to the premixer injectors 300. Fuel from a fuel source (not shown in FIG. 2) enters the premixer injectors 300. Air and fuel are mixed in the premixer injectors 300. The mixture of air and fuel enters the combustor chamber 210, as indicated by the arrow line, and is ignited in the combustor chamber 210. The ignited mixture of air and fuel exits the combustor chamber 210 through the chamber exit 212 and enters the turbine section 106.

In operation of the gas turbine engine 100 of FIG. 1, with reference to FIG. 3, FIG. 4, and FIG. 5, air from the compressor section 102 is split to the primary air flow 332 and the secondary air flow 334 at the inlet end 302 of the premixer injector 300, the premixer injector 400, or the premixer injector 500. The primary air flow 332 includes a majority portion of the air and flows into the premixer duct 310. The secondary air flow 334 includes the rest of the air and flows into the secondary duct 324. The fuel lance 312 injects the fuels into the premixer duct 310 to mix with the primary air flow 332. Vortices may be generated on the primary air flow 332 by the vortex generator 322 to improve the mixture. The secondary air flow 334 enters the premixer duct 310 from the secondary duct 324 through the plurality of apertures 328 along the first wall 306. The secondary air flow 334 are mixed together with the mixture of the fuels and the primary air flow 332 in the premixer duct 310. The mixture of the fuels and the primary air flow 332 and the secondary air flow 334 are discharged out of the premixer injector 300 or the premixer injector 400 or the premixer injector 500 at the outlet end 304. The discharge is ignited to form a flame 336.

In operation of the gas turbine engine 100 of FIG. 1, with reference to FIG. 5, the secondary air flow 334 also flows into the third duct 504 through the plurality of orifices 510 along the second wall 308 so that the third duct 504 becomes a wave resonator. The wave resonator may be a ¼ wave resonator or any desired wave resonator. The third duct 504 may also become a high frequency dynamics damping resonator. The secondary air flow 334 also flows to an exterior of the premixer injector 500 from the third duct 504 through the plurality of openings 508 along the third wall 502. The secondary air flow 334 flows to the exterior of the premixer injector 500 is used as purge air to purge the third duct 504 functioned as the wave resonator and/or the high frequency dynamics damping resonator.

The arrangement of the premixer injector 300, the premixer injector 400, or the premixer injector 500 distributes the injection of a portion of the air, the secondary air flow 334, into the premixer duct 310 along the premixer duct 310 to mix with the fuels, rather than injecting all air into the premixer duct 310 from the inlet end 302. Such an arrangement improves air-fuel-ratio damping capability. The arrangement also improves the acoustic attenuation in the combustion section 104. The arrangement mitigates boundary layer flashback by leaning the air-fuel mixture near the first wall 306. The arrangement mitigates coking, auto ignition, and flashback while operating on liquid fuel by creating an air buffer at the first wall 306 to inhibit wall-wetting. The premixer injector 300, the premixer injector 400, and the premixer injector 500 are each designed with a sufficiently high pressure drop across the first wall 306 such that the fuels are not ingested into the secondary duct 324.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

LISTING OF DRAWING ELEMENTS

100 gas turbine engine
102 compressor section
104 combustion section
106 turbine section
108 inlet section
110 exhaust portion
112 central axis
114 compressor stage
116 stationary vane
118 rotating blade
120 combustor
122 exhaust gas
124 turbine stage
126 stationary turbine vane
128 rotating turbine blade
130 turbine inlet
132 control system
134 rotor
200 combustor
202 casing
204 inlet
206 premixer injector assembly
208 combustor liner
210 combustor chamber

212 chamber exit
214 primary block
216 secondary block
300 premixer injector
302 inlet end
304 outlet end
306 first wall
308 second wall
310 premixer duct
312 fuel lance
314 liquid fuel tube
316 gas fuel tube
318 liquid fuel outlet
320 gas fuel outlet
322 vortex generator
324 secondary duct
326 strut
328 aperture
330 perforated plate
332 primary air flow
334 secondary air flow
336 flame
400 premixer injector
402 outer wall
404 first section
406 second section
408 planar panel
500 premixer injector
502 third wall
504 third duct
506 bar
508 opening
510 orifice

What is claimed is:

1. A premixer injector assembly in a gas turbine engine, the premixer injector assembly comprising:

a plurality of premixer injectors, each premixer injector of the plurality of premixer injectors comprising:

an inlet end;

an outlet end;

a first wall between the inlet end and the outlet end, the first wall comprising a plurality of apertures circumferentially separated around the first wall and axially separated along the first wall, each aperture passing through the first wall;

a premixer duct defined by an interior of the first wall;

a second wall between the inlet end and the outlet end, the second wall completely surrounding the first wall;

a secondary duct defined between the first wall and the second wall;

a fuel lance disposed in the premixer duct at the inlet end; and a perforated plate disposed circumferentially around the secondary duct at the inlet end, wherein the fuel lance comprises a gas fuel tube and a liquid fuel tube.

2. The premixer injector assembly of claim 1, wherein the gas fuel tube surrounds the liquid fuel tube.

3. The premixer injector assembly of claim 1, wherein the fuel lance comprises a vortex generator attached to an outer perimeter of an outer wall of the fuel lance.

4. The premixer injector assembly of claim 1, wherein each premixer injector further comprises a plurality of struts circumferentially separated around the secondary duct and axially separated along the secondary duct.

5. The premixer injector assembly of claim 1, wherein the second wall comprises a first section and a second section, and wherein a diameter of the first section is different from a diameter of the second section.

6. The premixer injector assembly of claim 1, wherein each premixer injector further comprises a third wall at least partially surrounding the second wall, wherein a third duct is defined between the second wall and the third wall.

7. The premixer injector assembly of claim 6, wherein the second wall comprises a plurality of orifices circumferentially separated around the second wall and axially separated along the second wall.

8. The premixer injector assembly of claim 6, wherein each premixer injector further comprises a bar disposed circumferentially around the third duct.

9. The premixer injector assembly of claim 6, wherein the third wall comprises a plurality of openings circumferentially separated around the third wall and axially separated along the third duct.

10. A premixer injector assembly operable to mix a fuel and an air, the premixer injector assembly comprising:

a plurality of premixer injectors, each premixer injector of the plurality of premixer injectors comprising:

a first wall enclosing a premixer duct having an inlet end for an admission of a primary air flow into the premixer duct and an outlet end for a discharge of a mixture of fuel and air, the first wall including a plurality of apertures circumferentially separated around the first wall and axially separated along the first wall, each aperture passing through the first wall;

a fuel lance disposed in the premixer duct at the inlet end, the fuel lance operable to inject the fuel into the premixer duct;

a second wall positioned to completely surround the first wall defining a secondary duct therebetween, the second wall having an inlet end for an admission of a secondary air flow into the secondary duct, wherein the secondary air flow enters the premixer duct via the plurality of apertures and is added to the mixture of fuel and air; and a perforated plate disposed circumferentially around the secondary duct at the inlet end, wherein the fuel lance comprises a gas fuel tube and a liquid fuel tube.

11. The premixer injector assembly of claim 10, wherein the gas fuel tube surrounds the liquid fuel tube.

12. The premixer injector assembly of claim 10, wherein the fuel lance comprises a vortex generator attached to an outer perimeter of an outer wall of the fuel lance.

13. The premixer injector assembly of claim 10, wherein each premixer injector further comprises a plurality of struts circumferentially separated around the secondary duct and axially separated along the secondary duct.

14. The premixer injector assembly of claim 10, wherein the second wall comprises a first section and a second section, and wherein a diameter of the first section is different from a diameter of the second section.

15. The premixer injector assembly of claim 10, wherein each premixer injector further comprises a third wall at least partially surrounding the second wall, wherein a third duct is defined between the second wall and the third wall.

16. The premixer injector assembly of claim 15, wherein the second wall comprises a plurality of orifices circumferentially separated around the second wall and axially separated along the second wall.

17. The premixer injector assembly of claim 15, wherein each premixer injector further comprises a bar disposed circumferentially around the third duct.

18. The premixer injector assembly of claim 15, wherein the third wall comprises a plurality of openings circumferentially separated around the third wall and axially separated along the third duct.

19. A premixer injector assembly in a gas turbine engine, the premixer injector assembly comprising:

a plurality of premixer injectors, each premixer injector of the plurality of premixer injectors comprising:

an inlet end;

an outlet end;

a first wall between the inlet end and the outlet end, the first wall comprising a plurality of apertures circumferentially separated around the first wall and axially separated along the first wall, each aperture passing through the first wall;

a premixer duct defined by an interior of the first wall;

a second wall between the inlet end and the outlet end, the second wall completely surrounding the first wall;

a secondary duct defined between the first wall and the second wall;

a fuel lance disposed in the premixer duct at the inlet end, wherein the fuel lance comprises a gas fuel tube and a liquid fuel tube; and a third wall at least partially surrounding the second wall, wherein a third duct is defined between the second wall and the third wall, wherein the second wall comprises a plurality of orifices circumferentially separated around the second wall and axially separated along the second wall.

* * * * *